United States Patent [19]

Fink et al.

[11] Patent Number: 4,566,522

[45] Date of Patent: Jan. 28, 1986

[54] HOT CHAMBER DIE CASTING MACHINE

[75] Inventors: Roland Fink, Winterbach; Walter Klingenstein, Urbach-Nord, both of Fed. Rep. of Germany

[73] Assignee: Oskar Frech GmbH and Co., Fed. Rep. of Germany

[21] Appl. No.: 555,446

[22] Filed: Nov. 28, 1983

Related U.S. Application Data

[63] Continuation of Ser. No. 263,063, May 13, 1981, abandoned.

[30] Foreign Application Priority Data

May 13, 1980 [DE] Fed. Rep. of Germany ..... 3018288

[51] Int. Cl.[4] ..... B22D 17/04; B22D 17/26

[52] U.S. Cl. ..... 164/316; 164/303; 164/309; 164/343

[58] Field of Search ..... 164/113, 137, 309, 311, 164/313, 314, 316, 317, 318, 342, 343

[56] References Cited

U.S. PATENT DOCUMENTS

| | | | |
|---|---|---|---|
| 2,684,510 | 7/1954 | Muller | 164/318 |
| 3,701,377 | 10/1972 | Fisher | 164/309 |
| 4,154,286 | 5/1979 | Glazunov | 164/314 |

*Primary Examiner*—Nicholas P. Godici
*Assistant Examiner*—Richard K. Seidel
*Attorney, Agent, or Firm*—Craig and Burns

[57] ABSTRACT

A hot chamber die casting machine for a processing of molten metals. The die casting machine includes a frame having a slanted surface for accommodating a closing unit. The closing unit is operable from a cross-head by way of a toggle lever mechanism and is mounted on guide bars supported at the frame. The closing unit includes two mold mounting tables which are adapted to be pressed together. A scissors-type linkage mechanism is disposed below the closing unit and includes transversely joined levers with a drive arrangement being provided for spreading the linkage mechanism so as to enable an adjustment of the closing unit.

21 Claims, 4 Drawing Figures

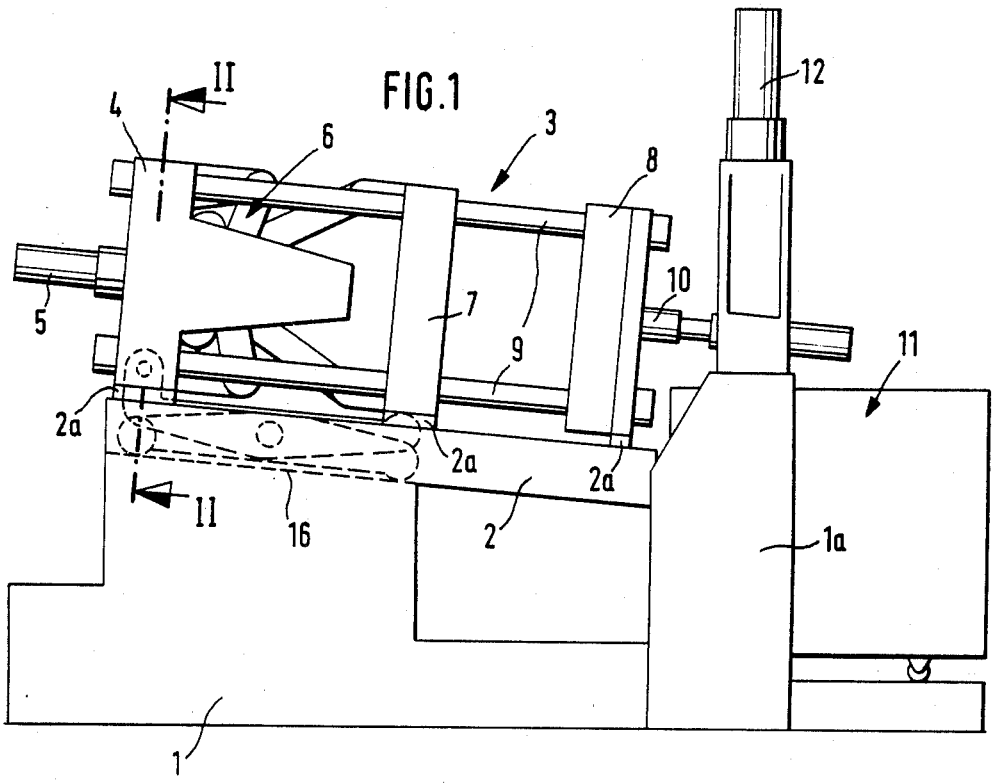
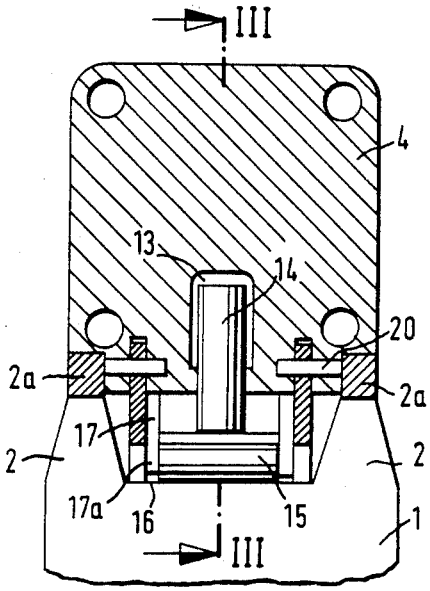
FIG.2

HOT CHAMBER DIE CASTING MACHINE

This is a continuation of application Ser. No. 263,063, filed May 13, 1981, now abandoned.

The present invention relates to a casting machine and, more particularly, to a hot chamber die casting machine for processing molten metals, with the die casting machine including a closing unit arranged on a slanted guide surface provided on a frame, with the closing unit being operable from a crosshead or crossbeam by a toggle lever mechanism and being mounted on guide bars, and with the closing unit being fashioned of two mold mounting tables capable of being pressed together.

A number of hot chamber die casting machines have been proposed with various structural arrangements being provided taking into account factors, such as, for example, the type of workpiece to be produced and the type of mold to be used. For this purpose, various pouring gates may be provided in the mold and, for example, the pouring may take place in a middle or central area of the mold so that the mold is centrally filled if, for example, a round workpiece or part is to be produced. For other types of workpieces or parts, it may be necessary to shift the pouring to the bottom of the mold because of, for example, production engineering considerations making it unfeasible to pour from the center of the mold.

Since a pouring ladle constantly remains in the melt, the injection means in the hot chamber die casting machines is not vertically adjustable but a closing means thereof is vertically adjusted in accordance with a position of a gate of the mold. In this connection, it has been proposed to lift the closing unit by means of a crane or fork-lift and to arrest a fixed mold mounting table accordingly with the injection means in a desired new position. A disadvantage of this proposal resides in the fact that this type of vertical adjustment is rather costly and complicated.

For larger die casting machines, it has also been proposed to produce the frame in two parts with an upper portion, provided with the guide surface, fashioned as a so-called head frame, which may be lifted above hydraulic cylinders located in the under or lower part of the frame. A disadvantage of this proposed construction resides in the fact that surfaces between the underframe and the guideframe and the guide surface itself must be very accurately machined so that the injection means such as, for example, a nozzle in each case fits the pouring gate. Moreover, an alignment of differently machined surfaces also requires a considerable assembly effort.

It has also been proposed to utilize a large adjusting cylinder; however, a disadvantage of such proposal resides in the fact that it is very difficult to obtain sufficient clearance under a movable mold mounting table and, if several cylinders are provided, it is necessary to provide for a synchronization control in order to prevent the tilting of the head frame.

The aim underlying the present invention essentially resides in providing a vertical adjustment means for a closing unit of a hot chamber die casting machine.

In accordance with advantageous features of the present invention, a hot chamber die casting machine of the aforementioned type is provided wherein a scissors type linkage or mechanism constructed of transversely joined levers is arranged below the closing unit with the scissors type linkage or mechanism being adapted to be spread by way of a drive.

Advantageously, in accordance with the present invention, if the scissors type linkage or mechanism rests against a bottom surface of the crosshead of the closing unit and a movable mounting table, with such a situation, the necessary clearance is maintained in a lower part of the area in which the molds are disposed.

In accordance with additional advantageous features of the present invention, a hydraulic cylinder piston unit is arranged in the crosshead of the closing unit, with the piston being adapted to operate the scissors type linkage or mechanism so as to lift or raise the closing unit. The scissors type linkage or mechanism may include a two armed lever one arm of which is mounted at the crosshead and a center of which is pivotably mounted to a center of a second lever, with the second arm of the two armed lever resting on a frame of the machine so that a control piston of the hydraulic cylinder-piston unit depresses one side of the arm of the second lever, which arm is associated to the pivoted arm of the first lever so that the other arm of the second lever rests against a bottom surface of the mold mounting table.

By virtue of the above-noted features of the present invention, no additional space is required since the space necessary to accommodate the adjusting cylinder is available in the crosshead of the closing unit thereby providing an additional advantage in that it is feasible to retrofit existing machinery.

In accordance with the present invention, one pair of levers is provided on respective sides of the crosshead, with the pairs of levers being connected to each other at the end of the second lever acted upon by the control piston by a cross bar, with the cross bar being adapted to be depressed or displaced by the control piston. By virtue of these constructional features, a very compact rugged lifting unit is attained which enables the entire closing unit to be lifted so that different guide shoes or sliders of desired strength may then be placed on the inclined mounted guide rails. Advantageously, the control piston may be a hydraulic piston which is integrated in a hydraulic control circuit.

Accordingly, it is an object of the present invention to provide a hot chamber die casting machine which avoids, by simple means, shortcomings and disadvantages encountered in the prior art.

Another object of the present invention resides in providing a hot chamber die casting machine which dispenses with the need for providing a split supporting frame.

A still further object of the present invention resides in providing a hot chamber die casting machine and, more particularly, a lifting mechanism for a closing unit of a die casting machine which minimizes the total number of guide surfaces thereby dispensing with need for machining of several guide surfaces as in die casting machines with split frames.

A still further object of the present invention resides in providing a hot chamber die casting machine and, more particularly, a lifting device for a hot chamber die casting machine which may be readily incorporated into the machine without requiring a large installation space.

A still further object of the present invention resides in providing a hot chamber die casting machine which functions realiably under all operating conditions.

These and other objects, features, and advantages of the present invention will become more apparent from the following description when taken in connection with the accompanying drawings which show, for the purposes of illustration only, one embodiment in accordance with the present invention, and wherein:

FIG. 1 is a schematic side view of a hot chamber die casting machine constructed in accordance with the present invention;

FIG. 2 is a partial cross sectional view taken along the line II—II in FIG. 1;

Figure 3:
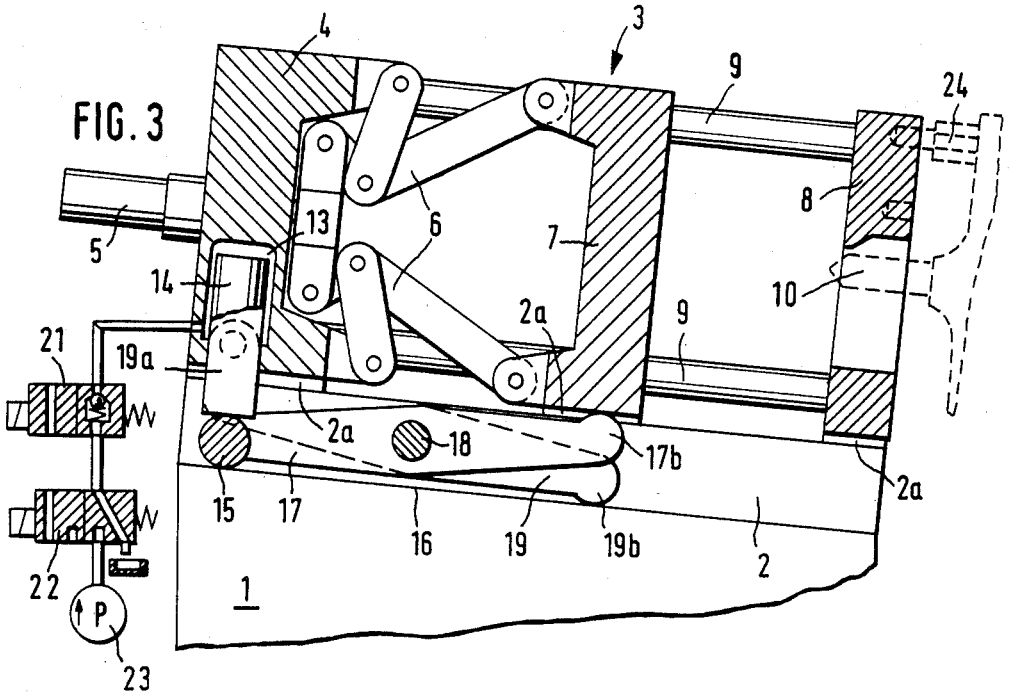
FIG. 3 is a cross sectional view taken along the line III—III in FIG. 2 illustrating a closing unit disposed opposite to an injection means and a gate position aligned with a center of a mold.

Referring now to the drawings wherein like reference numerals are used through the various views to designate like parts and, more particularly, to FIG. 1, according to this Figure, a frame 1 has arranged thereon spaced guide rails 2, disposed at an angle of inclination of approximately 5% with respect to a horizontal plane, with a closing unit generally designated by the reference numeral 3, a displaceable mold mounting table 7, and a fixed mold mounting table 8 being disposed on the guide rails 2. The closing unit 3 includes a crosshead 4 with a drive cylinder 5 for a toggle mechanism generally designated by the reference numeral 6. The displaceable mold mounting table 7 is pivoted to the toggle mechanism 6. The crosshead 4, the movable mold mounting table 7, and the fixed mold mounting table 8 are each mounted on guide bars 9 and are secured in their respective positions. The crosshead 4, the adjustable mold mounting plate 7, and fixed mold mounting table 8 are guided on the guide rails 2 through exchangeable sliders or guide shoes 2*a*.

The fixed mold mounting table 8 is positioned against an arresting or stopping means and is rigidly secured in a position opposite to a pouring means such as, for example, an injection nozzle 10 which, as shown in FIGS. 1 and 3, is aligned in a center gate position for a center filling of a mold (not shown). The displaceable mold mounting table 7 is disposed opposite the mounting table 8, with the mold being disposed between the mounting tables 7, 8. The injection nozzle 10 is connected, in a conventional manner, to a pouring ladle (not shown), which is adapted to dip into a liquid melt accommodated in a displaceable crucible generally designated by the reference numeral 11 of a furnace. The pouring ladle is connected to a hydraulic piston acted upon by a hydraulic cylinder 12 mounted on a frame portion 1*a* to which the displaceable crucible 11 is connected.

Figure 4:
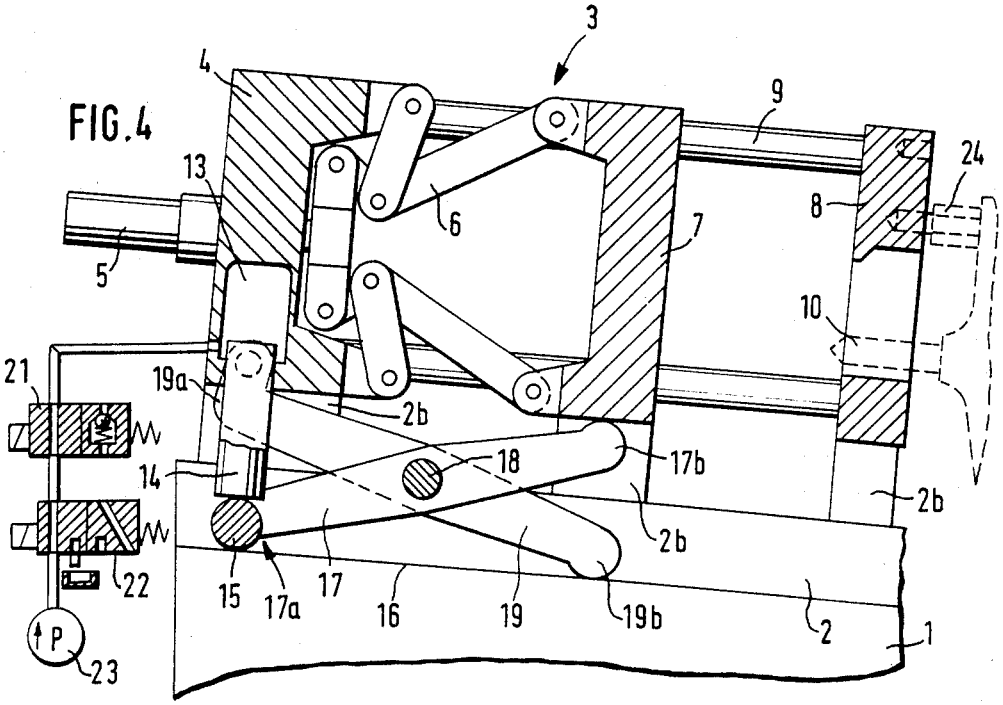
FIG. 4 is a cross sectional view similar to FIG. 3 with a closing unit in a lifted position and with additional guide rails disposed beneath in a gate position aligned with a lower mold area.

As shown most clearly in FIGS. 2, 3, and 4, a hydraulic cylinder-piston unit is provided which includes a hydraulic cylinder 13 arranged in the crosshead 4, with the piston 14 being displaceably guided in the cylinder 13. A lower end face of the piston 14 cooperates with a pin-type cross bar 15 so as to depress the same. The cross bar 15 connects two ends 17*a* of levers 17 to each other, with the two ends 17*a* resting on a guide surface 16 of the frame 1, with the other ends 17*b* of the respective levers 17 resting against a bottom surface of the displaceable mold mounting table 7.

The two levers 17 are symmetrically disposed with respect to a longitudinal center axis III—III (FIG. 2) of the closing unit 3 and are pivotally joined to each other in a center area thereof by joint bolts 18 and to a center area of levers 19. The levers 19 are of the same length as the levers 17 and are each constructed as a two armed lever having a first end 19*a* pivotally connected by bolts 20 of the like to the crosshead 4 and second ends 19*b* resting on the guide surface 16 of the frame 1.

If, for example, due to a change in tooling or type of mold being used, it is necessary to change a position of the filling gate from, for example, the position illustrated in FIG. 3 to the position illustrated in FIG. 4, it is necessary to change or adjust the closing unit 3. For this purpose, a hydraulic circuit for the hydraulic cylinder-piston unit 13, 14 is operated. The hydraulic circuit includes a pressure medium source 23 and a valve means such as, for example, solenoid valves 21, 22. During a setting up or lifting operation of the closing unit 3, a suitable control switch (not shown), is closed and the solenoid valves 21, 22 are energized so that pressure medium from the pressure medium source 23 is supplied to the hydraulic cylinder 13 whereby the pressure in the initially balanced hydraulic cylinder 13 is increased and the piston 14 is displaced downwardly so as to depress the left ends 17*a* of the levers 17 causing the scissors type linkage or mechanism formed by the levers 17, 19 to lift or raise the entire closing unit 3 in an upward direction.

As is apparent from FIG. 4, the raising or lifting process of the closing unit 3 by the levers 17, 19 can be performed to the extent that different sliders or slidable guide shoes 2*b*, of a larger height and desired strength than the guide shoes 2*a*, may be placed on the guide rails 2 so that the nozzle 10 may be stopped or arrested in the illustrated position by, for example, additional safety stops 24, of conventional construction, accommodated in bores or the like provided in the fixed mold mounting table 8. With the injection nozzle 10 assuming the position illustrated in FIG. 4, it is possible for a pouring to take place in a lower half or bottom of a mold. The means for stopping or arresting the injection nozzle 10 in the illustrated position are merely schematically depicted since such means are of conventional construction.

As evident from the description set forth hereinabove, by virtue of the provisions of the scissors-type linkage or mechanism formed by the levers 17, 19, a means for lifting the closing unit is directly integrated particularly in or on the closing unit 3 thereby requiring very little installation space. Moreover, as apparent from FIGS. 3 and 4, a desired downward clearance is maintained in the space between the displaceable mold mounting tables 7 and the fixed mold mounting table 8 thereby guaranteeing easy access to the mold. Furthermore, since the displacement of the displaceable mold mounting table 7 may be accomplished by a conventional toggle mechanism 6, the mode of operation of the hot chamber die casting machine remains unchanged as compared with previously proposed constructions. Thus, a changing of position of the injection nozzle 10 when the molds and/or pouring gate positions are changed is substantially simple by virtue of the present invention.

While we have shown and described only one embodiment in accordance with the present invention, it is understood that the same is not limited thereto but is susceptible of numerous changes and modifications as known to one having ordinary skill in the art and we therefore do not wish to be limited to the details shown and described herein, but intend to cover all such modifications as are encompassed by the scope of the appended claims.

We claim:

1. A hot chamber die casting machine for processing molten metals, the machine comprising machine frame means, and a mold closing means mounted on the machine frame means and having a crosshead, a control piston means slidable with respect to the crosshead, a mold mounting table means displaceable with respect to said machine frame means, a scissors-type linkage means arranged below the closing means for adjusting a position of the mold closing means relative to the machine frame means, the scissors-type linkage means comprising at least a pair of levers, each of which is a two armed lever, means for pivotally connecting the levers to each other arranged in a center area of each of the levers, one arm of a first of the levers mounted at the crosshead with the second arm of the first lever resting on a guide surface means of the machine frame means, one arm of a second of the levers being arranged so as to be acted upon by said control piston means, with the second arm of said second lever resting against a bottom surface of said displaceable mold mounting table, and drive means for spreading the scissors-type linkage means so as to enable an adjustment of the mold closing means.

2. A hot chamber die casting machine according to claim 1, wherein a second mold mounting table against which said displaceable mold mounting table is pressed, and a toggle lever means for connecting one of the mounting table means with the cross head.

3. A hot chamber die casting machine according to claim 2, further comprising guide bar means on the machine frame means for mounting the closing means on the machine frame means arranged so as to be inclined relative to a substantially horizontal plane.

4. A hot chamber die casting machine according to claim 2, wherein said second mold mounting table is fixedly mounted at the mold closing means.

5. A hot chamber die casting machine for processing molten metals, the machine including machine frame means, and a mold closing means mounted on frame means, comprising the closing means including a crosshead, a pair of mold mounting tables adapted to be pressed together, and a toggle lever means for connecting one of the mounting table means with the crosshead, a scissors-type linkage means arranged below the closing means for adjusting a position of the closing means relative to the frame means, the scissors-type linkage means comprising at least a pair of levers, and means for pivotally connecting the levers to each other, one of the mold mounting tables being fixedly mounted at the closing unit and the other mold mounting table is displaceably mounted at the closing unit, and the scissors-type linkage means resting against a bottom surface of the crosshead and against the displaceably mounted mold mounting table, drive means for spreading the scissors-type linkage means so as to enable an adjustment of the closing means, the drive means comprising a hydraulic cylinder accommodated in the crosshead, and a control piston displaceably mounted in the hydraulic cylinder and cooperable with the scissors-type linkage means so as to spread the scissors-type linkage means.

6. A hot chamber die casting machine according to claim 5, wherein each of the levers of said scissors-type linkage means is a two armed lever, and further comprising means for pivotally connecting said levers positioned in a center area of each of the said levers, one arm of a first of the levers being mounted at the crosshead with the second arm of the first lever resting on a guide surface means of frame means, one arm of a second of the levers being arranged so as to be acted upon by the control piston, with the second arm of said second lever resting against a bottom surface of the displaceable mold mounting table.

7. A hot chamber die casting machine according to claim 6, wherein said one arm of the second lever is disposed in proximity to said one arm of said first lever.

8. A hot chamber die casting machine according to claim 7, wherein the guide surface means of the frame means is a guideway for the mold closing means.

9. A hot chamber die casting machine according to claim 8, wherein the drive means further comprises a controllable hydraulic circuit means having a pressure medium source means for supplying a pressure medium to the hydraulic cylinder, and control valve means for controlling a supply of the pressure medium to the hydraulic cylinder.

10. A hot chamber die casting machine according to claim 9, wherein the control valve means comprises electromagnetic valves arranged in the hydraulic circuit.

11. A hot chamber die casting machine for processing molten metals, the machine comprising machine frame means, and a mold closing means mounted on a frame means, the mold closing means comprising a crosshead, a pair of mold mounting tables adapted to be pressed together, and a toggle lever means for connecting one of the mounting table means with the crosshead, a scissors-type linkage means arranged below the mold closing means for adjusting a position of the closing means relative to the frame means, the scissors-type linkage means comprising a first pair of levers disposed on one lateral side of the crosshead and a second pair of levers disposed on an opposite lateral side of the crosshead, each of the levers is a two armed lever, means for pivotally connecting the levers to each other arranged in a center area of each of the levers, one arm of a first of the levers mounted at the crosshead with the second arm of the first lever resting on a guide surface means of the frame means, a control piston, one arm of a second of the levers arranged so as to be acted upon by said control piston, with the second arm of said second lever resting against a bottom surface of a displaceable mold mounting table, cross bar means for connecting a first end of each of the first pair of levers to each other, and drive means acting upon the crossbar means for spreading the scissors-type linkage means so as to enable an adjustment of the closing means.

12. A hot chamber die casting machine according to claim 11, wherein the first pair of lever means are disposed symmetrically with respect to a longitudinal center axis of the mold closing means.

13. A hot chamber die casting machine for processing molten metals, the machine including machine frame means, and a mold closing means mounted on frame means, the mold closing means including a crosshead, a pair of mold mounting tables adapted to be pressed together, a toggle lever means for connecting one of the mounting table means with the crosshead, a scissors-type linkage means arranged below the closing means for adjusting a position of the closing means relative to the frame means, the scissors-type linkage means comprising a first pair of levers disposed on one lateral side of the crosshead and a second pair of levers disposed on an opposite lateral side of the crosshead, cross bar means for connecting a first end of each of the first pair of levers to each other, the first pair of levers being disposed symmetrically with respect to a longitudinal center axis of the closing means, drive means for spreading the scissors-type linkage means so as to enable an adjustment of the mold closing means comprising a hydraulic cylinder accommodated in the crosshead, and a control piston displaceably mounted in the hydraulic cylinder, the control piston acting upon the cross bar means so as to depress the same.

14. A hot chamber die casting machine according to claim 13, wherein a first end of each of the second pair of levers is pivotally connected to the crosshead and a second end of each of the second pair of levers rests on a guide surface means of the frame means, and a second end of the first pair of levers rests on a bottom surface of one of the mounting tables.

15. A hot chamber die casting machine according to claim 14, wherein the guide surface means of the frame means is a guideway for the mold closing means formed between the guide bar means.

16. A hot chamber die casting machine according to claim 15, wherein the drive means further includes a controllable hydraulic circuit means having a pressure medium source means for supplying a pressure medium to the hydraulic cylinder, and control valve means for controlling a supply of the pressure medium to the hydraulic cylinder.

17. A hot chamber die casting machine according to claim 16, wherein the control valve means includes electromagnetic valves arranged in the hydraulic circuit.

18. A hot chamber die casting machine for processing molten metals, the machine including machine frame means, and a mold closing means mounted on frame means comprising, a scissors-type linkage means arranged below the mold closing means for adjusting a position of the mold closing means relative to the frame means, and drive means for spreading the scissors-type linkage means so as to enable an adjustment of the closing means, wherein the drive means includes a hydraulic cylinder accommodated in the mold closing means, a control piston displaceably mounted in the hydraulic cylinder, and the control piston acts upon the scissors-type linkage means so as to spread the same.

19. A hot chamber die casting machine for processing molten metals, the machine comprising machine frame means, and a mold closing means mounted on the frame means and having a crosshead, a scissors-type linkage means arranged below the closing means for adjusting a position of the closing means relative to the frame means, wherein the scissors-type linkage means comprises a first pair of levers disposed on one lateral side of the mold closing means and a second pair of levers disposed on an opposite lateral side of the mold closing means, each lever being a two armed lever, means for pivotally connecting the levers to each other arranged in a center area of each of the levers, one arm of a first of the levers mounted at the crosshead with the second arm of the first lever resting on a guide surface means of the frame means, a control piston, one arm of a second of the levers arranged so as to be acted upon by said control piston, with the second arm of said second lever resting against a bottom surface of a displaceable mold mounting table, cross bar means are provided for connecting a first end of each of the first pair of levers to each other, and drive means acting upon the cross bar means for spreading the scissors-type linkage means so as to enable an adjustment of the mold closing means.

20. A hot chamber die casting machine for processing molten metals, the machine comprising frame means, and a mold closing means mounted on frame means, a scissors-type linkage means arranged below the closing means for adjusting a position of the closing means relative to the frame means, the scissors-type linkage means comprising a first pair of levers disposed on one lateral side of the closing means and a second pair of levers disposed on an opposite lateral side of the closing means, cross bar means for connecting a first end of each of the first pair of levers to each other, wherein a first end of each of the second pair of levers is pivotally connected to the closing unit and a second end of each of the second pair of levers rests on a guide surface means of the frame means, and drive means acting upon said cross bar means for spreading the scissors-type linkage means so as to enable an adjustment of the mold closing means.

21. A hot chamber die casting machine according to claim 20, wherein the drive means includes a hydraulic cylinder accommodated in the mold closing means, and a control piston displaceably mounted in the hydraulic cylinder, the control piston acting upon the cross bar means so as to depress the same.

* * * * *